US010468212B2

(12) United States Patent
Groehl et al.

(10) Patent No.: US 10,468,212 B2
(45) Date of Patent: Nov. 5, 2019

(54) ELECTRICAL SWITCH METHODS AND APPARATUS

(71) Applicant: Siemens Industry, Inc., Alpharetta, GA (US)

(72) Inventors: Troy Groehl, Marysville, OH (US); Dan A. Fisher, Dublin, OH (US)

(73) Assignee: SIEMENS INDUSTRY, INC., Alphapretta, GA (US)

( * ) Notice: Subject to any disclaimer, the term of this patent is extended or adjusted under 35 U.S.C. 154(b) by 184 days.

(21) Appl. No.: 15/701,898

(22) Filed: Sep. 12, 2017

(65) Prior Publication Data

US 2019/0080865 A1 Mar. 14, 2019

(51) Int. Cl.

| | |
|---|---|
| ***H01H 21/36*** | (2006.01) |
| ***H01H 21/22*** | (2006.01) |
| ***H01H 11/00*** | (2006.01) |
| ***H01H 21/42*** | (2006.01) |
| *H01H 21/58* | (2006.01) |

(52) U.S. Cl.

CPC ..... *H01H 21/36* (2013.01); *H01H 11/00* (2013.01); *H01H 21/22* (2013.01); *H01H 21/42* (2013.01); *H01H 21/58* (2013.01); *H01H 2205/002* (2013.01); *H01H 2235/01* (2013.01)

(58) Field of Classification Search

CPC ..... H01H 21/38; H01H 21/36; H01H 21/52; H01H 21/42; H01H 2235/01

See application file for complete search history.

(56) References Cited

U.S. PATENT DOCUMENTS

| | | | | |
|---|---|---|---|---|
| 2,125,684 | A * | 8/1938 | Millermaster | H01H 21/38 200/329 |
| 2,134,986 | A | 11/1938 | Rach | |
| 2,332,633 | A | 10/1943 | Green | |
| 5,850,909 | A * | 12/1998 | Wagner | H01H 21/38 200/501 |
| 6,331,684 | B1 * | 12/2001 | Abroy | H01H 21/42 200/17 R |
| 6,373,009 | B1 * | 4/2002 | Prohaska | H01H 3/001 200/401 |
| 7,368,677 | B2 | 5/2008 | Jones et al. | |
| 8,362,384 | B2 | 1/2013 | Mortun | |
| 8,680,409 | B2 | 3/2014 | Birner et al. | |

* cited by examiner

*Primary Examiner* — Felix O Figueroa

(57) ABSTRACT

An apparatus for an electrical switch that includes a rotor cam having a rotor interface, a handle interface, and a spring arm interface. The rotor interface includes a plurality of side interface features that couple the rotor cam to a rotor of the electrical switch so that rotation of the rotor cam causes rotation of the rotor. The handle interface allows coupling of the rotor cam to a handle, wherein the handle interface is sized so as to allow a predetermined amount of independent rotation of the handle relative to the rotor cam before further rotation of the handle causes rotation of the rotor cam. The spring arm interface couples a spring arm of the electrical switch to the rotor cam so that a bias spring of the spring arm biases the spring arm against the rotor cam. Numerous other embodiments are provided.

20 Claims, 8 Drawing Sheets

ELECTRICAL SWITCH METHODS AND APPARATUS

FIELD

The present application relates to power supply systems, and more particularly to electrical switch methods and apparatus.

BACKGROUND

Electrical switches are used to deliver electrical power to various loads, such as circuit panels or other power delivery systems, air conditioning units, or the like. Because of the large currents that may flow through such switches, the switches typically are designed so that they cannot be partially opened or closed. Partially opening a switch can result in arcing and switch damage, and may be a fire hazard.

Mechanisms for ensuring switches are not partially opened or partially closed add complexity and costs to switch designs. As such, methods and apparatus for reducing the complexity and cost of switch designs are desirable.

SUMMARY

In some embodiments, an apparatus for an electrical switch is provided that includes a rotor cam having a rotor interface, a handle interface and a spring arm interface. The rotor interface includes a plurality of side interface features that couple the rotor cam to a rotor of the electrical switch so that rotation of the rotor cam causes rotation of the rotor between an open position and a closed position. The handle interface allows coupling of the rotor cam to a handle, wherein the handle interface is sized so as to allow a predetermined amount of independent rotation of the handle relative to the rotor cam before further rotation of the handle causes rotation of the rotor cam. The spring arm interface couples a spring arm of the electrical switch to the rotor cam so that a bias spring of the spring arm biases the spring arm against the rotor cam.

In some embodiments, an electrical switch is provided that includes (a) a rotor having a plurality of blades, wherein rotation of the rotor causes the blades of the rotor to rotate between an open position that creates an open circuit path and a closed position that creates a closed circuit path through the switch; (b) a rotor cam having a rotor interface, a handle interface and a spring arm interface; (c) a spring arm having a bias spring coupled to the spring arm; and (d) a handle. The rotor interface includes a plurality of side interface features that couple the rotor cam to the rotor so that rotation of the rotor cam causes rotation of the rotor. The handle interface allows coupling of the rotor cam to the handle and the handle interface is sized so as to allow a predetermined amount of independent rotation of the handle relative to the rotor cam before further rotation of the handle causes rotation of the rotor cam. The spring arm interface couples the spring arm to the rotor cam so that the spring arm is biased against the rotor cam by the bias spring while the rotor cam rotates the rotor between the open and closed positions.

In some embodiments, a method of forming an electrical switch is provided that includes (a) providing a rotor having a plurality of blades, wherein rotation of the rotor causes the blades of the rotor to rotate between an open position that creates an open circuit path and a closed position that creates a closed circuit path through the electrical switch; (b) providing a rotor cam having a rotor interface, a handle interface and a spring arm interface; (c) providing a spring arm having a bias spring coupled to the spring arm; and (d) providing a handle. The rotor interface includes a plurality of side interface features that couple the rotor cam to the rotor so that rotation of the rotor cam causes rotation of the rotor between the open position and the closed position. The handle interface allows coupling of the rotor cam to the handle and the handle interface is sized so as to allow a predetermined amount of independent rotation of the handle relative to the rotor cam before further rotation of the handle causes rotation of the rotor cam. The spring arm interface couples the spring arm to the rotor cam so that the spring arm is biased against the rotor cam by the bias spring while the rotor cam rotates the rotor between the open and closed positions. The method further includes (e) coupling the rotor cam to the rotor using the side interface features of the rotor cam; (f) coupling the rotor cam to the handle using the handle interface of the rotor cam; and (g) coupling the rotor cam to the spring arm using the spring arm interface of the rotor cam. Numerous other aspects and/or embodiments are provided.

Other features and aspects of the present invention will become more fully apparent from the following detailed description, the appended claims, and the accompanying drawings.

DETAILED DESCRIPTION

Electrical switches that supply large currents, such as 60 amp or larger general duty switches, generally are designed so that they cannot be partially opened or closed. Partially opening or closing such switches could result in arcing, damage to the switches and fire.

In a typical switch design, three cams and one or more bias springs are employed to ensure that an operator of the switch cannot restrain the operation of the switch after the switch's contacts have touched or parted. That is, the operator cannot partially open or close the switch. In such a switch design, a handle cam, spring cam, and rotor cam work together to control switch operation. A typical switch includes a rotor having one or more blades that may be rotated so that one side of the blade contacts a supply or line side of the switch and one side of the blade contacts a load side of the switch. In this condition, the switch is on (closed) and current may flow from the supply to load through the switch. Likewise, the rotor may be rotated to break contact between the blades and the load/supply, so that switch is off (open).

The handle cam is attached to the handle of the switch and rotates with the handle. A spring cam couples to the handle cam and rotates therewith. The spring cam attaches to a main mechanism spring which provides a bias force that maintains the switch in either an on (closed) or off (open) state. A rotor cam transfers the force from the spring cam to the rotor of the switch so that the rotor maintains rotational position in either an open or closed state.

To reduce the complexity and cost of switches, embodiments are provided in which a single rotor cam provides the function of the handle cam, spring cam and rotor cam of a conventional switch. Such a switch design is less expensive to manufacture and maintain, and easier to assemble. Fewer parts and fewer interfaces may improve switch reliability.

These and other embodiments provided herein are described with reference to FIGS. 1A-6.

Figure 1A:
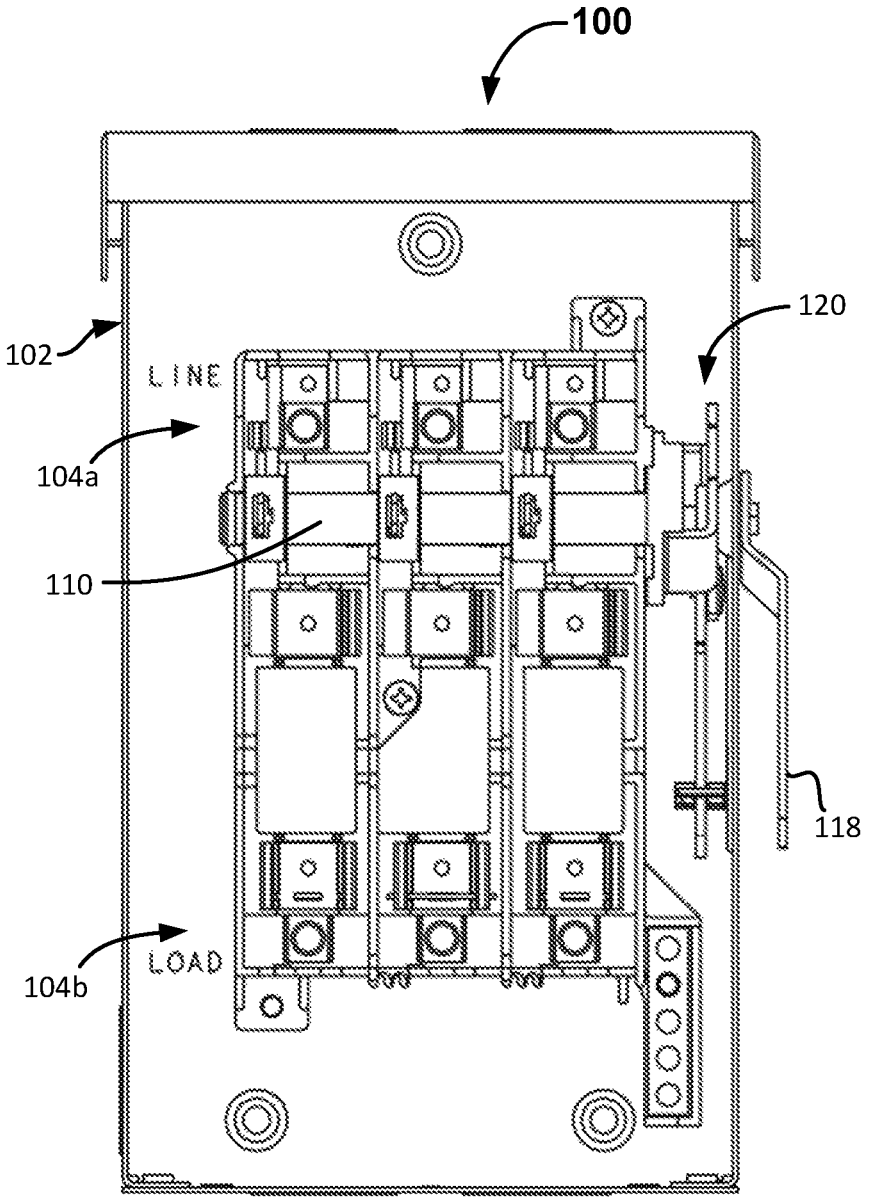
FIGS. 1A and 1B are a front plan view and front perspective view, respectively, of an electrical switch provided in accordance with embodiments described herein.
Figure 1B:
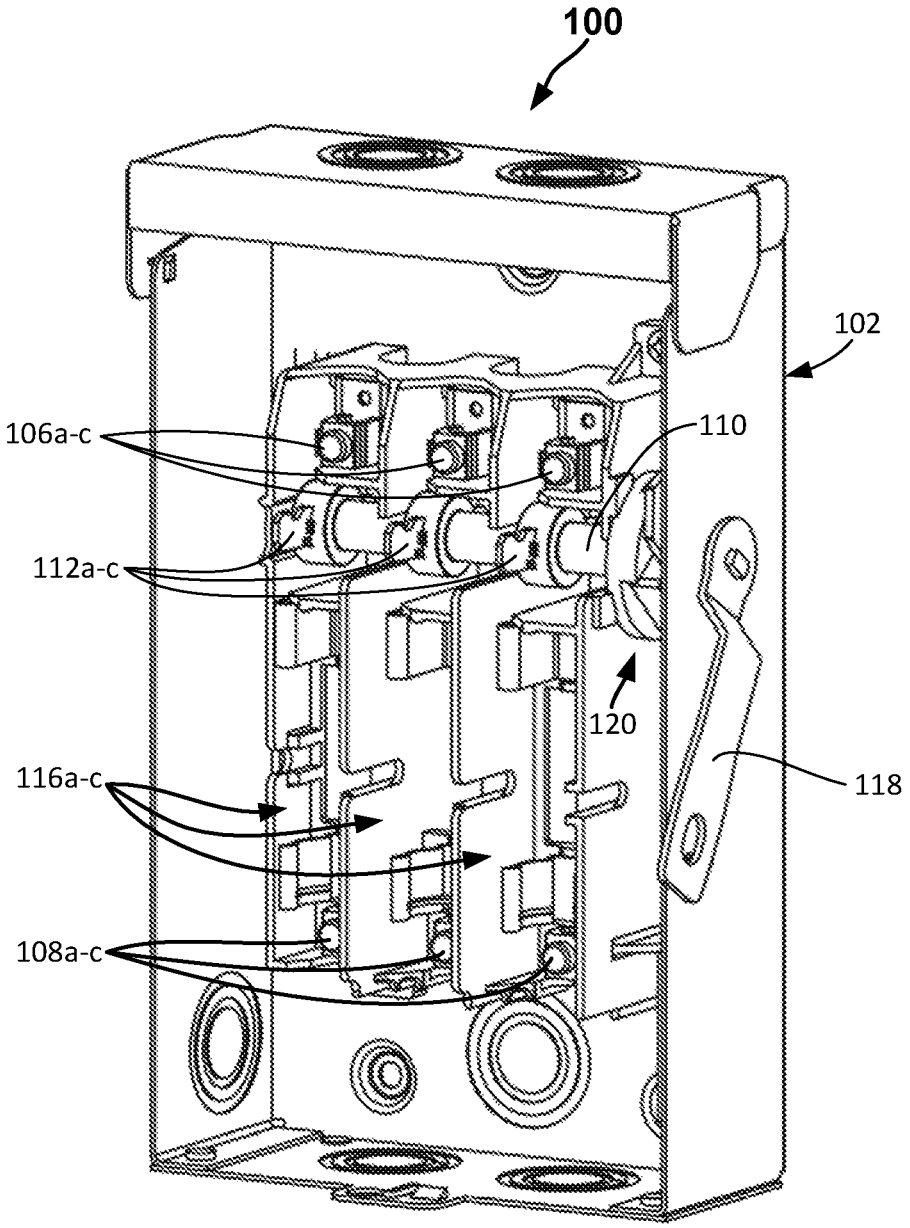

FIGS. 1A and 1B are a front plan view and front perspective view, respectively, of an electrical switch 100 provided in accordance with embodiments described herein. With reference to FIGS. 1A and 1B, the electrical switch 100 includes an enclosure 102 having a line (supply) side 104*a* and a load side 104*b*. Voltage and/or current is supplied to the line side 104*a* at line side connections 106*a-c* and received at the load side 104*b* at load side connections 108*a-c* (FIG. 1B). While three line paths are shown in FIGS. 1A-1B, it will be understood that fewer or more line paths may be employed (e.g., 1, 2, 4, 5, etc.). Electrical switch 100 may be a fused or unfused switch.

Figure 3A:
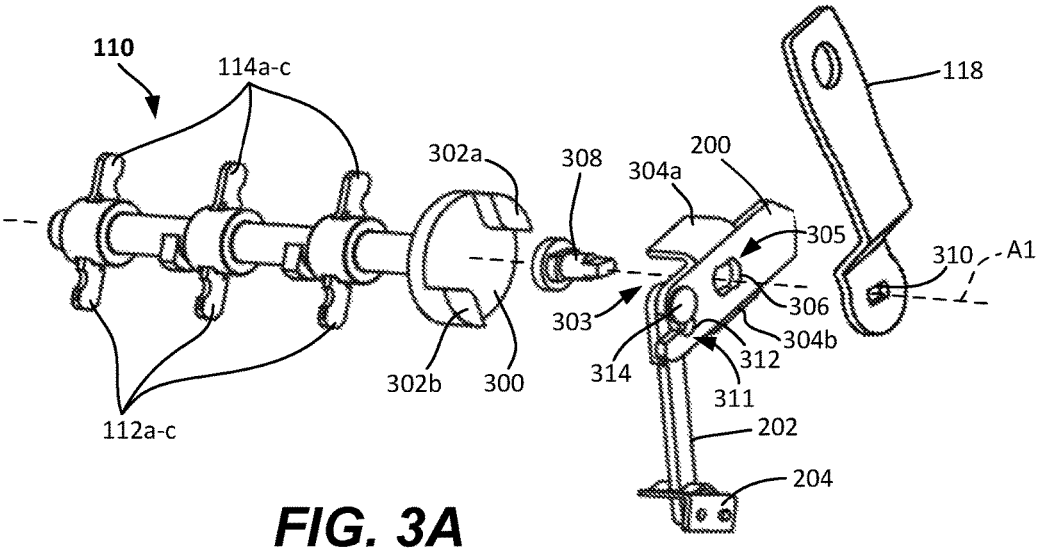
FIG. 3A is a side perspective view of a rotor and rotor cam assembly in accordance with embodiments described herein.

Electrical switch 100 includes a rotor 110 having a first set of blades 112*a-c* and a second set of blades 114*a-c* (not shown in FIGS. 1A-1C, shown in FIG. 3A). First and second sets of blades 112*a-c* and 114*a-c* are located on approximately opposite sides of rotor 110, and rotor 110 may be rotated so that the first set of blades 112*a-c* makes electrical contact to line side connections 106*a-c* (e.g., touch and/or connect directly or through one or more other conductive element(s) not shown) at the same time that the second set of blades 114*a-c* (FIG. 3A) make electrical contact to load side connections 108*a-c* (e.g., touch and/or connect directly or through another conductive element, such as fuses (not shown) located in fuse housings 116*a-c*). Specifically, rotation of rotor 110 clockwise in FIG. 1B may result in the electrical switch 100 being on (closed) when blades 112*a-c*, 114*a-c* are rotated to create an electrical path from line side connections 106*a-c* to load side connections 108*a-c*. Likewise, rotation of rotor 110 counter-clockwise in FIG. 1B may result in the electrical switch 100 being off (open) when blades 112*a-c*, 114*a-c* are rotated to open (break) an electrical path from line side connections 106*a-c* to load side connections 108*a-c* as described further below.

Electrical switch 100 may include a handle 118 that is coupled to rotor 110 through a rotor cam assembly 120 as described below with reference to FIGS. 2-3. Handle 118 may therefore be rotated clockwise (when closing electrical switch 100) or counter-clockwise (when opening electrical switch 100). Example embodiments of rotor cam assembly 120 are described below with reference to FIGS. 2-4D.

Figure 2:
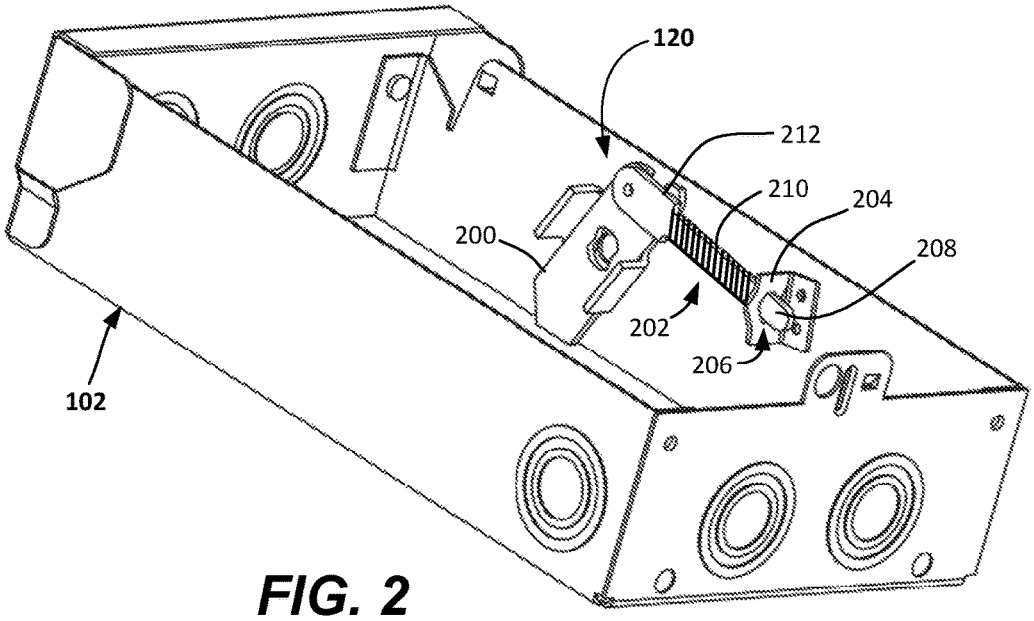
FIG. 2 is a side perspective view of an enclosure of the electrical switch of FIGS. 1A and 1B that illustrates a rotor cam assembly in accordance with embodiments described herein.

FIG. 2 is a side perspective view of enclosure 102 of switch 100 illustrating the rotor cam assembly 120. With reference to FIG. 2, rotor cam assembly 120 includes a rotor cam 200 coupled to a spring arm 202. A spring arm connector 204 is shown coupled to enclosure 102 and provides an opening 206 through which a shaft portion 208 of spring arm 202 may pass (e.g., slide). A bias spring 210 surrounds or otherwise couples to the shaft portion 208 and contacts a head portion 212 of spring arm 202 and spring arm connector 204. Bias spring 210 is compressed and exerts a force against both head portion 212 of spring arm 202 and spring arm connector 204 so as to bias spring arm 202 against rotor cam 200 as described further below.

FIG. 3A is a side perspective view of rotor 110 and rotor cam assembly 120 of electrical switch 100 which illustrates how rotor 110, rotor cam assembly 120 and handle 118 may be coupled in some embodiments. With reference to FIG. 3A, rotor 110 includes a coupling surface 300 having one or more protrusions 302*a-b*. While the coupling surface 300 is shown having two protrusions 302*a-b*, it will be understood that other numbers of protrusions may be used.

Rotor cam 200 includes a rotor interface 303 (shown in FIG. 3A and FIG. 4A) that may include a plurality of side interface features that couple rotor cam 200 to rotor 110 of electrical switch 100 so that rotation of rotor cam 200 causes rotation of rotor 110 between an open position and a closed position. For example, rotor interface 303 of rotor cam 200 may include one or more side flanges 304*a-b* (304*b* shown more clearly in FIG. 4A) that are sized to fit between protrusions 302*a-b* of coupling surface 300 so that rotation of rotor cam 200 causes rotor 110 to rotate (via contact between flanges 304*a-b* and protrusions 302*a-b* of coupling surface 300). As shown in FIG. 3A, in some embodiments, the protrusions 302*a-b* of coupling surface 300 of rotor 110 may have a thickness that increases toward the center of the protrusions 302*a-b*. Such an arrangement may facilitate alignment and/or positioning of the rotor cam 200 relative to the rotor 110 (e.g., such that the rotor cam 200 is aligned along a central axis A1 of the rotor 110 as shown in FIG. 3A). Other protrusion shapes and/or configurations may be employed.

Figure 3B:
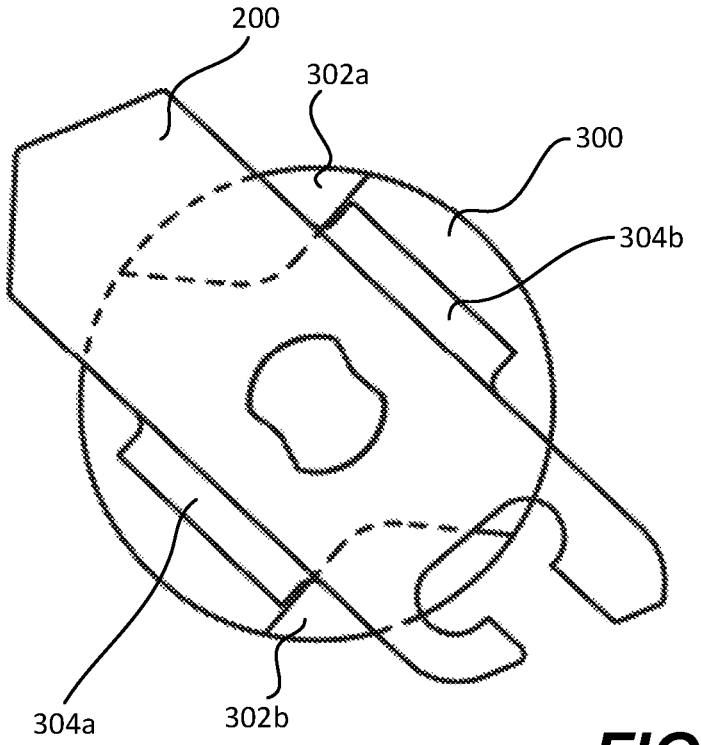
FIGS. 3B and 3C are top plan views of a rotor cam coupled to a coupling surface of a rotor in accordance with one or more embodiments provided herein.
Figure 3C:
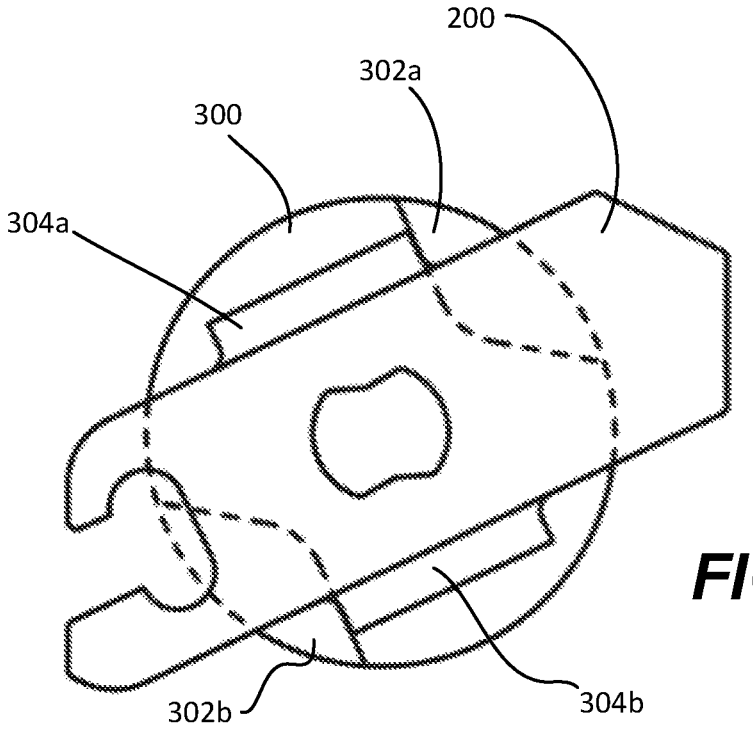

FIGS. 3B and 3C are top plan views of rotor cam 200 coupled to coupling surface 300 of rotor 110 in accordance with one or more embodiments provided herein. As will be described further below, in some embodiments, flanges 304*a-b* are sized so that they do not extend fully between the protrusions 302*a-b*. During a portion of closing or opening electrical switch 100, this may allow rotor cam 200 to rotate independently of rotor 110 over a predefined angle before contacting protrusions 302*a* and/or 302*b* with flanges 304*a* and/or 304*b*, and causing rotation of rotor 110 by rotor cam 200. For example, in FIG. 3B, rotor cam 200 may rotate clockwise without rotating rotor 110 until flange 304*b* contacts protrusion 302*b* (FIG. 3C). Likewise, in FIG. 3C, rotor cam 200 may rotate counter-clockwise without rotating rotor 110 until flange 304*b* contacts protrusion 302*a*. In some embodiments, rotor cam 200 may rotate approximately 20-30 degrees independently relative to rotor 110, although other degrees of rotation may be provided.

Referring again to FIG. 3A, rotor cam 200 may include a handle interface 305 that allows coupling of the rotor cam 200 to handle 118. For example, handle interface 305 may be sized so as to allow a predetermined amount of independent rotation of handle 118 relative to rotor cam 200 before further rotation of handle 118 causes rotation of rotor cam 200. In some embodiments, handle interface 305 of rotor cam 200 may include an opening 306 in rotor cam 200 along a rotational axis (e.g., central axis A1 in FIG. 3A) of rotor cam 200. Opening 306 may be sized so as to allow a predetermined amount of independent rotation of the handle 118 relative to rotor cam 200 before further rotation of the handle 118 causes rotation of rotor cam 200 as described further below with reference to FIGS. 4A-4B.

In the embodiment of FIG. 3A, a rivet, screw, bolt or other securing device, generally referred to as handle securing mechanism 308, may extend through opening 306 of handle interface 305 of rotor cam 200 and securely connect to handle 118, such as at handle slot 310. Any suitable method may be used to secure handle securing mechanism 308 to slot 310 (e.g., use of an adhesive, use of friction and/or compression, and/or the like).

Rotor cam 200 may include a spring arm interface 311 that couples spring arm 202 of electrical switch 100 to rotor cam 200 so that spring arm 202 is biased against rotor cam 200 by bias spring 210 (FIG. 2). For example, spring arm interface 311 may include a slot 312 (see FIG. 3A and FIGS. 4A-4B) through which a rivet, screw, bolt or other securing mechanism 314 coupled to spring arm 202 may extend. Slot 312 of spring arm interface 311 allows spring arm 202 (via securing mechanism 314) to slide relative to rotor cam 200 during rotation of rotor cam 200 as described below with reference to the operation of electrical switch 100 and FIGS. 5A and 5B.

Figure 4A:
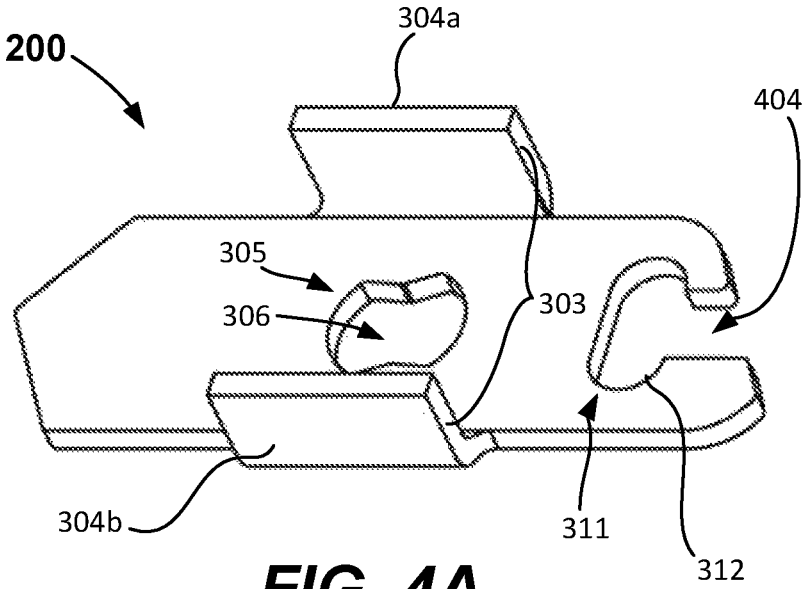
FIGS. 4A and 4B are a front perspective view and a top plan view, respectively, of a rotor cam in accordance with embodiments provided herein.
Figure 4B:
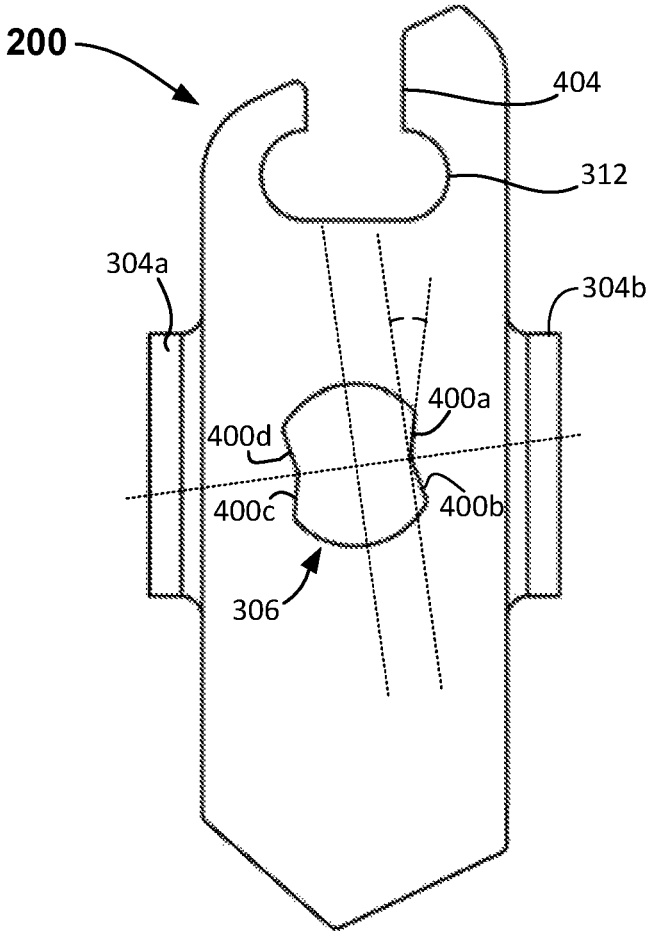

FIGS. 4A and 4B are a front perspective view and a top plan view of rotor cam 200 provided in accordance with example embodiments described herein. The various interfaces of rotor cam 200 are shown, such as rotor interface 303 having flanges 304*a-b*, handle interface 305 having opening 306, and spring arm interface 311 having slot 312.

As described with reference to FIG. 3A, in some embodiments, opening 306 of handle interface 305 may be sized so as to allow a predetermined amount of independent rotation of the handle 118 relative to rotor cam 200 before further rotation of handle 118 causes rotation of rotor cam 200. As shown in FIG. 4B, opening 306 may include one or more angled interface regions 400*a-d* so that when the rotor cam 200 is coupled to handle 118 with securing mechanism 308, the one or more angled interface regions 400*a-d* allow the securing mechanism 308 to pivot with handle 118 a predetermined angular range relative to rotor cam 200 before further rotation of handle 118 causes rotation of the rotor cam 200. Example predetermined angular ranges include 20-30 degrees in some embodiments, although other values may be used.

Figure 4C:
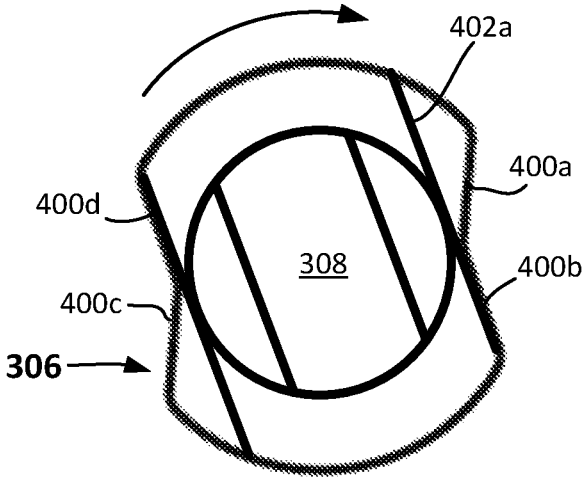
FIGS. 4C and 4D are top plan views of a securing mechanism within an opening of a rotor cam prior to clockwise (FIG. 4C) and counter-clockwise (FIG. 4D) rotation in accordance with embodiments described herein.
Figure 4D:
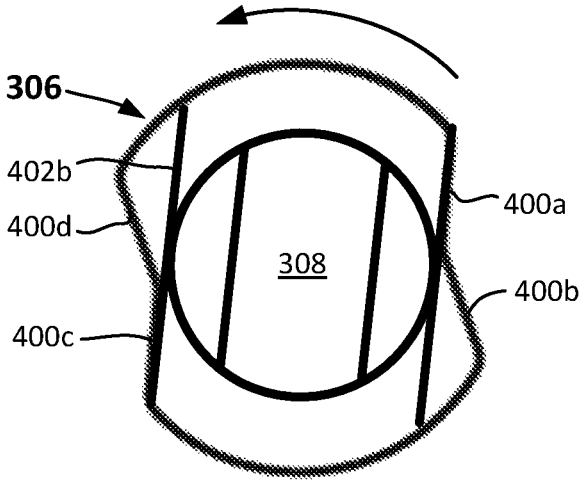

FIGS. 4C and 4D are top plan views of securing mechanism 308 within opening 306 of rotor cam 200 prior to clockwise (FIG. 4C) and counter-clockwise (FIG. 4D) rotation of handle 118. In the position of FIG. 4C, handle 118 is able to rotate clockwise without rotating rotor cam 200 until a first side 402*a* of securing mechanism 308 contacts angled interface region 400*a* of opening 306 (such contact is shown in FIG. 4D). Likewise, in the position of FIG. 4D, handle 118 is able to rotate counter-clockwise without rotating rotor cam 200 until a second side 402*b* of securing mechanism 308 contacts angled interface region 400*d* of opening 306 (such contact is shown in FIG. 4C). In some embodiments, each angled interface region 400*a-d* is angled so as to allow about 20-30 degrees of independent rotation of the handle 118 clockwise (after electrical switch 100 is opened) or counter-clockwise (after electrical switch 100 is closed) before further rotation of handle 118 causes rotation of rotor cam 200.

By allowing some rotational freedom of rotor cam 200 relative to handle 118 and some rotational freedom of rotor cam 200 relative to rotor 110 (as described above with reference to FIGS. 3B-3C and FIGS. 4C-4D), spring arm 202 is able to drive the electrical switch 100 to either an open (off) position or closed (on) position by rotation of rotor cam 200 once handle 118 is moved sufficiently in a clockwise or counter-clockwise direction.

With reference to FIGS. 4A and 4B, spring arm interface 311 may include an opening 404 that allows spring arm 202 to be attached to rotor cam 200 easily (e.g., during assembly or maintenance of electrical switch 100). For example, securing mechanism 314 (FIG. 3A) of spring arm 202 may be slid into (or be removed from) slot 312 of spring arm interface 311 through opening 404.

In some embodiments, rotor cam 200 may be formed from galvanized steel or another suitable material, as may spring arm 202, spring arm connector 204, handle 118, etc.

Operation of the rotor cam 200, and more generally electrical switch 100, is described with reference to FIGS. 5A-5B which are side views of a portion of electrical switch 100 in an open (off) state and closed (on) state, respectively.

Figure 5A:
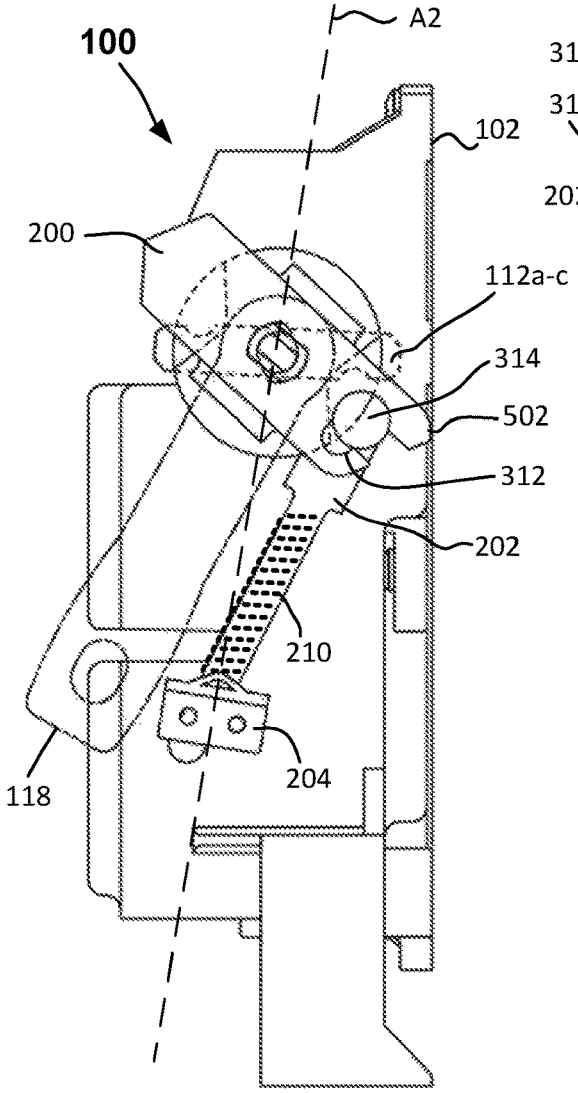
FIGS. 5A-5B are side views of a portion of an electrical switch in an open (off) state and closed (on) state, respectively, in accordance with embodiments described herein.

When in an open or off state, as shown in FIG. 5A, blades 112*a-c* are rotated away from line side connections 106*a-c* and load side connections 108*a-c* (FIG. 1B). Handle 118 points downward in FIG. 5A, and bias spring 210 presses spring arm 202 against rotor cam 200. Specifically, bias spring 210 presses securing mechanism 314 against rotor cam 200 within slot 312 such that a first contact surface 502 of rotor cam 200 rotates into contact with enclosure 102.

Figure 5B:
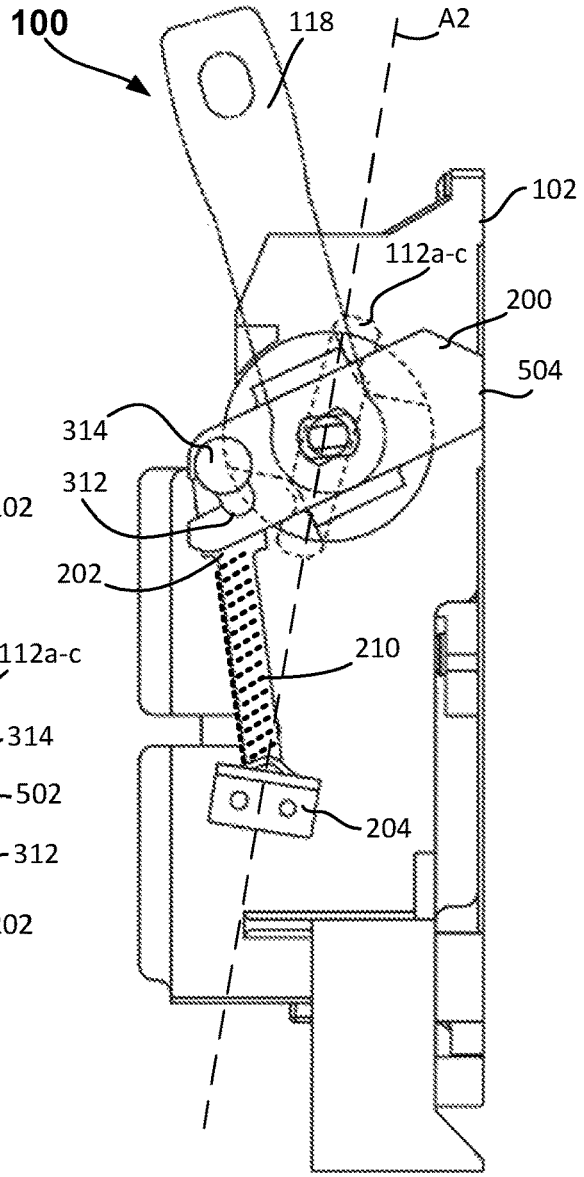

To place electrical switch 100 in a closed or on state, as shown in FIG. 5B, handle 118 is rotated clockwise. Rotating handle 118 clockwise causes rotor cam 200 to rotate clockwise, which causes bias spring 210 to compress as securing mechanism 314 of spring arm 202 rotates downward toward spring arm connector 204. Once securing mechanism 314 rotates clockwise past an axis A2 through securing mechanism 308 of handle 118, bias spring 210 causes securing mechanism 314 of spring arm 202 to slide to an opposite side of slot 312 of rotor cam 200 as shown in FIG. 5B, and rotor cam 200 is biased to rotate in the clockwise direction. Blades 112*a-c* are rotated with rotor cam 200 into a closed position (FIG. 5B) so that line side connections 106*a-c* and load side connections 108*a-c* are electrically connected. Bias spring 210 presses securing mechanism 314 against rotor cam 200 within slot 312 such that a second contact surface 504 of rotor cam 200 rotates into contact with enclosure 102. In some embodiments, once securing mechanism 314 of spring arm 202 cross axis A2, bias spring 210 rotates rotor cam 200 to the position shown in FIG. 5B independent of the position of handle 118 (because of the freedom of rotation provided to rotor cam 200 relative to handle 118 and/or rotor 110 as described above with reference to FIGS. 3B-3C and FIGS. 4D-4C).

To return electrical switch 100 to an open or off state, as shown in FIG. 5A, from the closed or on state of FIG. 5B, handle 118 is rotated counter-clockwise. Rotating handle 118 counter-clockwise causes rotor cam 200 to rotate counter-clockwise, which causes spring 210 to compress as securing mechanism 314 of spring arm 202 rotates downward toward spring arm connector 204 until securing mechanism 314 rotates past axis A2. Once securing mechanism 314 of spring arm 202 rotates past securing mechanism 308 of handle 118 (e.g., past axis A2), bias spring 210 causes securing mechanism 314 of spring arm 202 to slide to an opposite side of slot 312 as shown in FIG. 5A, and rotor cam 200 is biased to rotate in the counter-clockwise direction. Blades 112*a-c* are rotated with rotor cam 200 into an opened position (FIG. 5A) so that line side connections 106*a-c* and load side connections 108*a-c* are not electrically connected. Bias spring 210 presses securing mechanism 314 against rotor cam 200 within slot 312 such that the first contact surface 502 of rotor cam 200 rotates into contact with enclosure 102. In some embodiments, once securing mechanism 314 of spring arm 202 cross axis A2, bias spring 210 rotates rotor cam 200 to the position shown in FIG. 5A independent of the position of handle 118 (because of the freedom of rotation provided to rotor cam 200 relative to handle 118 and/or rotor 110 as described above with reference to FIGS. 3B-3C and FIGS. 4D-4C).

Use of a rotor cam having a rotor interface, handle interface and spring arm interface reduces the complexity and cost of switches which typically employ a separate cam for each of these functions. That is, rotor cam assembly 120 allows a single rotor cam to provide the function of the handle cam, spring cam and rotor cam of a conventional switch. Such a switch design is less expensive to manufacture and maintain, and easier to assemble. Fewer parts and fewer interfaces may improve switch reliability.

Figure 6:
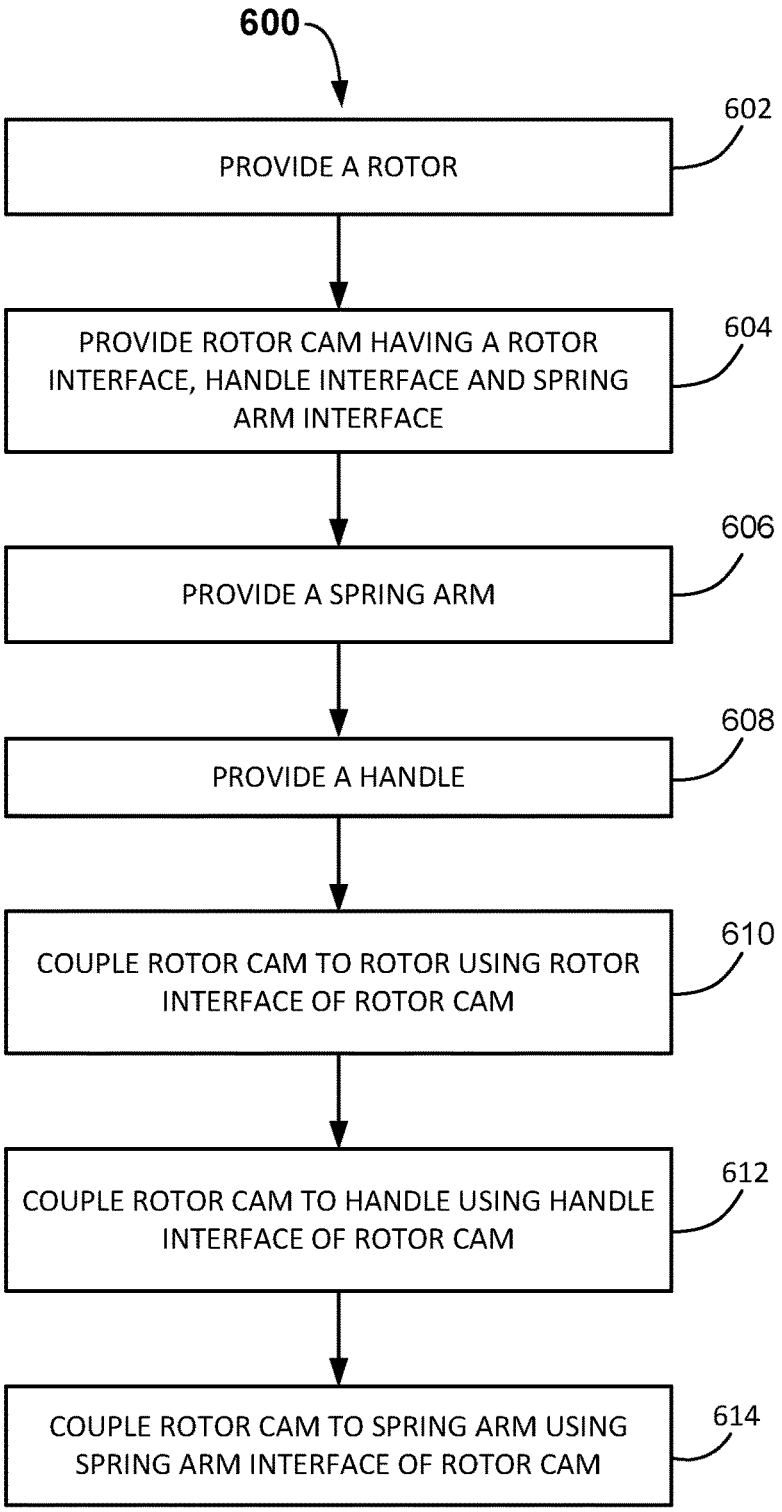
FIG. 6 is an example method of forming an electrical switch in accordance with embodiments provided herein.

FIG. 6 is an example method 600 of forming an electrical switch in accordance with embodiments provided herein. With reference to FIG. 6, in Block 602, a rotor is provided. For example, the rotor may have a plurality of blades, and rotation of the rotor may cause the blades of the rotor to rotate between an open position that creates an open circuit path and a closed position that creates a closed circuit path through the switch. In Block 604, a rotor cam is provided that includes a rotor interface, a handle interface and a spring arm interface. In Block 606, a spring arm is provided and in Block 608, a handle is provided. In Block 610, the rotor cam is coupled to the rotor using the rotor interface of the rotor cam. In Block 612, the rotor cam is coupled to the handle using the handle interface of the rotor cam. In Block 614, the rotor cam is coupled to the spring arm using the spring arm interface of the rotor cam.

The rotor interface may include a plurality of side interface features that couple the rotor cam to the rotor so that rotation of the rotor cam causes rotation of the rotor between the open position and the closed position. The handle interface allows coupling of the rotor cam to the handle and in some embodiments, the handle interface may be sized so as to allow a predetermined amount of independent rotation of the handle relative to the rotor cam before further rotation of the handle causes rotation of the rotor cam. The spring arm interface may couple the spring arm to the rotor cam so that a bias spring of the spring arm is biased against the rotor cam while the rotor cam rotates the rotor between the open and closed positions. In some embodiments, a predetermined amount of independent rotation of the rotor relative to the rotor cam may be provided.

The foregoing description discloses only example embodiments of the invention; modifications of the above disclosed apparatus and method which fall within the scope of the invention will be readily apparent to those of ordinary skill in the art. Accordingly, while the present invention has been disclosed in connection with the example embodiments thereof, it should be understood that other embodiments may fall within the spirit and scope of the invention, as defined by the following claims.

What is claimed is:

1. An apparatus for an electrical switch comprising:

a rotor cam having a rotor interface, a handle interface and a spring arm interface;

wherein the rotor interface includes a plurality of side interface features that couple the rotor cam to a rotor of the electrical switch so that rotation of the rotor cam causes rotation of the rotor between an open position and a closed position;

wherein the handle interface allows coupling of the rotor cam to a handle, wherein the handle interface is sized so as to allow a predetermined amount of independent rotation of the handle relative to the rotor cam before further rotation of the handle causes rotation of the rotor cam; and wherein the spring arm interface couples a spring arm of the electrical switch to the rotor cam so that a bias spring of the spring arm biases the spring arm against the rotor cam, wherein the handle interface includes an opening in a surface of the rotor cam along a rotational axis of the rotor cam, wherein the rotor interface includes two side flanges that interface with corresponding features of the rotor of the electrical switch, and wherein the two side flanges are facing each other and are oriented substantially perpendicular to the surface of the rotor cam having the opening.

2. The apparatus of claim 1 wherein the rotor interface includes the two side flanges so that rotation of the rotor cam causes rotation of the rotor between an open position and a closed position.

3. The apparatus of claim 1 wherein the opening is sized so as to allow the predetermined amount of independent rotation of the handle relative to the rotor cam before further rotation of the handle causes rotation of the rotor cam.

4. The apparatus of claim 3 wherein the opening includes one or more angled interface regions so that when the rotor cam is coupled to the handle with a securing mechanism, the one or more angled interface regions allow the securing mechanism to pivot with the handle a predetermined angular range relative to the rotor cam before further rotation of the handle causes rotation of the rotor cam.

5. The apparatus of claim 4 wherein the one or more angled interface regions include four angled interface regions.

6. The apparatus of claim 4 wherein each angled interface region is angled so as to allow about 20-30 degrees of independent rotation of the handle before further rotation of the handle causes rotation of the rotor cam.

7. The apparatus of claim 1 wherein the rotor cam includes a first contact surface that contacts a switch enclosure when the rotor cam rotates the rotor to an open position and a second contact surface that contacts the switch enclosure when the rotor cam rotates the rotor to a closed position.

8. The apparatus of claim 7 wherein the first and second contacts surfaces are at different ends of the rotor cam.

9. The apparatus of claim 1 wherein the spring arm interface includes a slot that allows the spring arm to slide relative to the rotor cam during rotation of the rotor cam.

10. The apparatus of claim 9 wherein the slot includes an opening that allows the spring arm to be removed from the rotor cam.

11. An electrical switch comprising:

a rotor having a plurality of blades, wherein rotation of the rotor causes the blades of the rotor to rotate between an open position that creates an open circuit path and a closed position that creates a closed circuit path through the switch;

a rotor cam having a rotor interface, a handle interface and a spring arm interface;

a spring arm having a bias spring coupled to the spring arm; and a handle;

wherein the rotor interface includes a plurality of side interface features that couple the rotor cam to the rotor so that rotation of the rotor cam causes rotation of the rotor, wherein the handle interface allows coupling of the rotor cam to the handle and the handle interface is sized so as to allow a predetermined amount of independent rotation of the handle relative to the rotor cam before further rotation of the handle causes rotation of the rotor cam, wherein the spring arm interface couples the spring arm to the rotor cam so that the spring arm is biased against the rotor cam by the bias spring while the rotor cam rotates the rotor between the open and closed positions, wherein the handle interface includes an opening in a surface of the rotor cam along a rotational axis of the rotor cam, wherein the rotor interface includes one or more side flanges that interface with corresponding features of the rotor of the electrical switch, and wherein the one or more side flanges are facing each other and are oriented substantially perpendicular to the surface of the rotor cam having the opening.

12. The electrical switch of claim 11 wherein the rotor interface includes the one or more side flanges so that rotation of the rotor cam causes rotation of the rotor between an open position and a closed position.

13. The electrical switch of claim 11 wherein the opening is sized so as to allow the predetermined amount of independent rotation of the handle relative to the rotor cam before further rotation of the handle causes rotation of the rotor cam.

14. The electrical switch of claim 13 wherein the opening includes one or more angled interface regions so that when the rotor cam is coupled to the handle with a securing mechanism, the one or more angled interface regions allow the securing mechanism to pivot with the handle a predetermined angular range relative to the rotor cam before further rotation of the handle causes rotation of the rotor cam.

15. The electrical switch of claim 14 wherein the one or more angled interface regions include four angled interface regions.

16. The electrical switch of claim 14 wherein each angled interface region is angled so as to allow about 20-30 degrees of independent rotation of the handle before further rotation of the handle causes rotation of the rotor cam.

17. The electrical switch of claim 11 wherein the rotor cam includes a first contact surface that contacts a switch enclosure when the rotor cam rotates the rotor to an open position and a second contact surface that contacts the switch enclosure when the rotor cam rotates the rotor to a closed position.

18. The electrical switch of claim 11 wherein the spring arm interface includes a slot that allows the spring arm to slide relative to the rotor cam during rotation of the rotor cam.

19. A method of forming an electrical switch comprising:

providing a rotor having a plurality of blades, wherein rotation of the rotor causes the blades of the rotor to rotate between an open position that creates an open circuit path and a closed position that creates a closed circuit path through the electrical switch;

providing a rotor cam having a rotor interface, a handle interface and a spring arm interface;

providing a spring arm having a bias spring coupled to the spring arm;

providing a handle;

wherein the rotor interface includes a plurality of side interface features that couple the rotor cam to the rotor so that rotation of the rotor cam causes rotation of the rotor between the open position and the closed position;

wherein the handle interface allows coupling of the rotor cam to the handle and the handle interface is sized so as to allow a predetermined amount of independent rotation of the handle relative to the rotor cam before further rotation of the handle causes rotation of the rotor cam; and wherein the spring arm interface couples the spring arm to the rotor cam so that the spring arm is biased against the rotor cam by the bias spring while the rotor cam rotates the rotor between the open and closed positions;

coupling the rotor cam to the rotor using the side interface features of the rotor cam;

coupling the rotor cam to the handle using the handle interface of the rotor cam; and coupling the rotor cam to the spring arm using the spring arm interface of the rotor cam wherein the handle interface includes an opening in a surface of the rotor cam along a rotational axis of the rotor cam, wherein the rotor interface includes two side flanges that interface with corresponding features of the rotor of the electrical switch, and wherein the two side flanges are facing each other and are oriented substantially perpendicular to the surface of the rotor cam having the opening.

20. The method of claim 19 wherein the spring arm interface of the rotor cam includes a slot that allows the spring arm to slide relative to the rotor cam during rotation of the rotor cam, the slot including an opening that allows the spring arm to be coupled to or removed from the rotor cam and further comprising attaching the spring arm to the rotor cam using the opening in the slot of the spring arm interface of the rotor cam.

* * * * *